US008440964B2

(12) United States Patent
Berkout et al.

(10) Patent No.: US 8,440,964 B2
(45) Date of Patent: May 14, 2013

(54) MULTIPLE ION GUIDE OPERATING AT ELEVATED PRESSURES

(75) Inventors: Vadym D Berkout, Rockville, MD (US); Vladimir M. Doroshenko, Sykesville, MD (US)

(73) Assignee: Science and Engineering Services, Inc., Columbia, MD (US)

( * ) Notice: Subject to any disclaimer, the term of this patent is extended or adjusted under 35 U.S.C. 154(b) by 108 days.

(21) Appl. No.: 13/213,787

(22) Filed: Aug. 19, 2011

(65) Prior Publication Data

US 2013/0043382 A1 Feb. 21, 2013

(51) Int. Cl.
*G21K 1/08* (2006.01)
*H01J 49/42* (2006.01)
*H01J 49/00* (2006.01)

(52) U.S. Cl.
USPC ..... 250/283; 250/396 R

(58) Field of Classification Search ..... 250/281–283, 250/288, 290, 292, 293, 396 R
See application file for complete search history.

(56) References Cited

U.S. PATENT DOCUMENTS 5,736,740 A * 4/1998 Franzen ..... 250/288
6,107,628 A * 8/2000 Smith et al. ..... 250/292
6,486,469 B1 * 11/2002 Fischer et al. ..... 250/288
6,583,408 B2 * 6/2003 Smith et al. ..... 250/288
6,943,347 B1 * 9/2005 Willoughby et al. ..... 250/288
7,259,371 B2 * 8/2007 Collings et al. ..... 250/288
7,781,728 B2 * 8/2010 Senko et al. ..... 250/281
7,982,183 B2 * 7/2011 Makarov et al. ..... 250/283
2009/0321655 A1 * 12/2009 Makarov et al. ..... 250/396 R

* cited by examiner

*Primary Examiner* — Bernard E Souw
(74) *Attorney, Agent, or Firm* — Oblon, Spivak, McClelland, Maier & Neustadt, L.L.P.

(57) ABSTRACT

A device and method for transporting ions along a longitudinal direction in an elevated gas pressure region. The device includes a multipole ion guide having a set of rods positioned along the longitudinal direction on an inscribed diameter equal to or less than 3.5 mm, a voltage source which provides alternating voltages to at least a subset of the rods to create a trapping field in a transverse direction, and a conductance limit having an opening d and placed at the exit of the multipole ion guide. At the end of this configuration near the opening of the conductance limit, a converging continuum gas flow through the conductance limit is provided that transfers the ions collimating near a center of the ion guide into a low gas pressure region. The method injects ions into the elevated gas pressure region of the ion guide, and transports the ions in the converging continuum gas flow into the low gas pressure region.

29 Claims, 5 Drawing Sheets

MULTIPLE ION GUIDE OPERATING AT ELEVATED PRESSURES

STATEMENT REGARDING FEDERALLY SPONSORED RESEARCH OR DEVELOPMENT

This invention was made within Contract HSHQDC-09-C-00181 with the US Government so the US Government has certain rights on the use of this invention.

BACKGROUND OF THE INVENTION

1. Field of Invention

This invention relates to the field of mass spectrometry. More specifically, this invention relates to procedures and devices for transporting of ions created at/or near atmospheric conditions into vacuum of a mass spectrometer.

2. Discussion of the Background

Multiple ionization techniques used in modern mass spectrometry operate at atmospheric pressure. To achieve the maximum sensitivity, ions must be transmitted with high efficiency through differentially pumped vacuum chambers into high vacuum region of the mass analyzer. The most challenging of the steps involved is ion transmission in the first chamber, which typically operates in Torr pressure region.

Due to demand for highly sensitive mass spectrometers with atmospheric pressure interfaces (API), there is a great interest in developing ion guide systems for transfer of ions at elevated pressures (≧1 Torr). Operation of interfaces at elevated pressures will permit the use of vacuum pumps with lower pumping speed to obtain the same gas intake or alternatively to increase the gas load through API using pumps with the same pumping speed.

There are two types of ion guides in which an alternating (radio frequency, or RF) electric field are used for trapping (focusing) ions in radial (transverse) direction along the ion pathway. The segmented ring electrode ion guide and its variations like ion tunnel or ion funnel (where the orifices in the ring electrodes vary along the ion pass way) are examples of the first type. Multipole ion guides having rod electrodes located along the ion pathway represent the second type. A direct current (DC) electric field for pushing (transferring) ions along the ion pathway can be created in both ion guide types.

Currently, ion funnels are used for transferring (and focusing) ions at elevated pressures. These devices can be made of very thin (e.g., less than 0.5-1.0 mm) metal rings separated by insulators of comparable thickness. This small step in ring electrode position along with high frequency (e.g., as high as 1.74 MHz) of the trapping RF voltages applied to the ring electrodes accounts for high efficiency of trapping ions in radial direction by ion funnel devices at elevated pressures as high as 29 Torr. See Smith et al. in the *J Am Soc Mass Spectrom* 2006, 17, 1299-1305, the entire contents of which are incorporated herein by reference.

Prior to this invention, multipole ion guides were not utilized for operations at elevated pressures >5-10 Torr, probably because the focusing properties of ion guides deteriorates at these higher pressure due to increasing number of defocusing gas collisions and due to an operational limit caused by gas discharge formation at higher RF voltages. Prior to this invention, the maximum operational pressures of multipole ion guides were typically in 1-2 Torr range. See Collins et al. U.S. Pat. No. 7,259,371, the entire contents of which are incorporated herein by reference. The mean free path $\lambda$ is about 0.2 mm at these pressures, which is comparable to a typical conductance limit diameter. At pressures of 1-2 Torr, gas flow in a region of the ion guide is far from a continuum gas flow regime and is close to a free molecular regime.

SUMMARY OF THE INVENTION

In one embodiment, there is provided a device for transporting ions along a longitudinal direction in an elevated gas pressure region. The device includes a multipole ion guide having a set of rods positioned along the longitudinal direction on an inscribed diameter equal to or less than 3.5 mm, a voltage source which provides alternating voltages to at least a subset of the rods to create a trapping field in a transverse direction, and a conductance limit having an opening d and placed at the exit of the multipole ion guide. At the end of this configuration near the opening of the conductance limit, a converging continuum gas flow through the conductance limit is provided that transfers the ions collimating near a center of the ion guide into a low gas pressure region.

In one embodiment, there is provided a method for transporting ions along a longitudinal direction in an elevated gas pressure region which injects ions into the elevated gas pressure region of the ion guide and transports the ions in the converging continuum gas flow into the low gas pressure region.

In one embodiment there is provided a system for transporting ions along a longitudinal direction in an elevated gas pressure region which includes 1) means for injecting ions into the elevated gas pressure region of an ion guide and 2) means for transporting the ions in a converging continuum gas flow which transfers the ions collimated near a center of the ion guide out of the elevated pressure of the ion guide into a low gas pressure region.

It is to be understood that both the foregoing general description of the invention and the following detailed description are exemplary, but are not restrictive of the invention.

BRIEF DESCRIPTION OF THE FIGURES

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

The invention makes possible the operation of multipole ion guides at elevated pressures higher than 5-10 Torr.

Figure 1A:
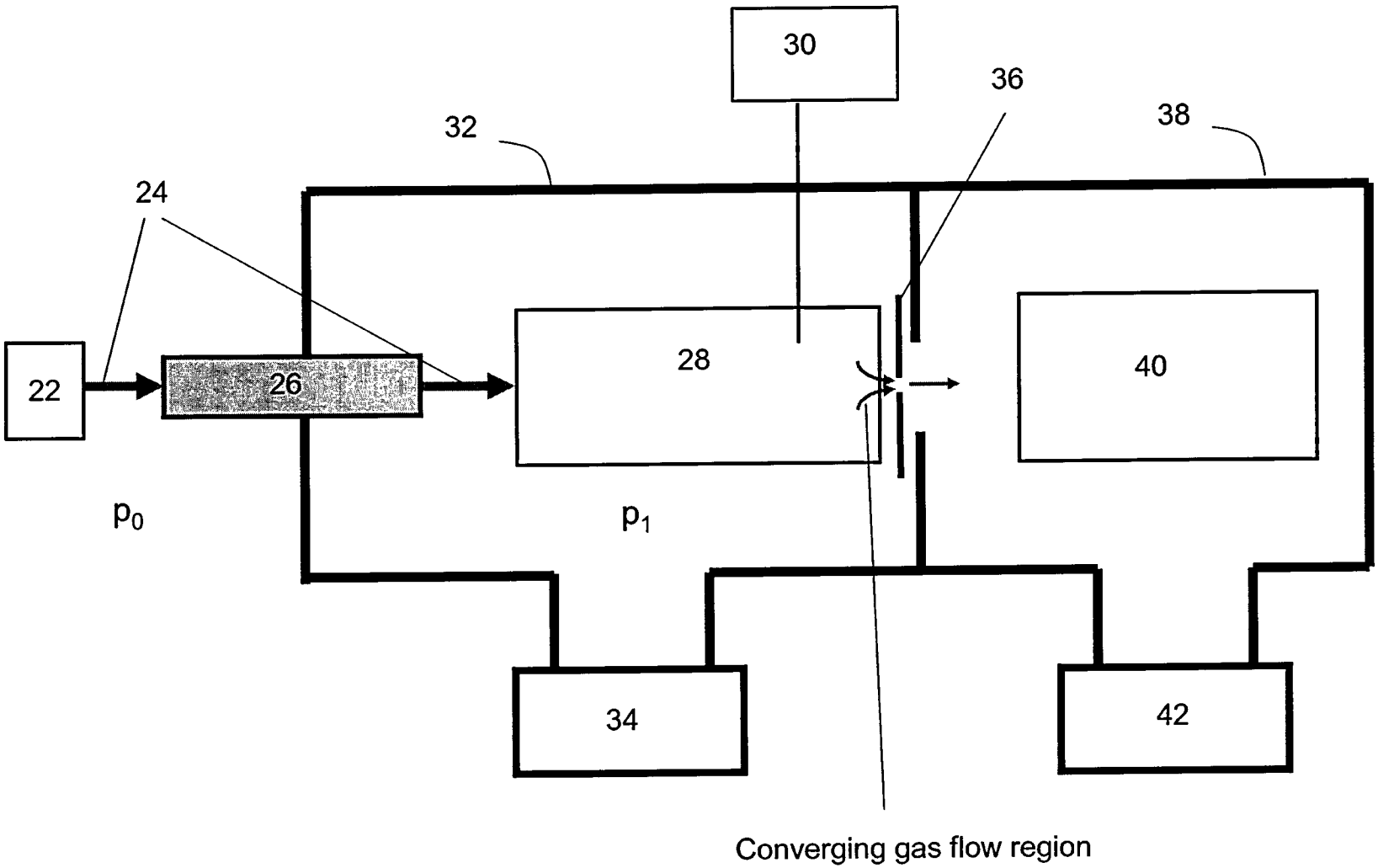
FIG. 1A is a schematic view of a mass spectrometer according to the present invention.

Referring now to the drawings, FIG. 1A shows schematically a mass spectrometer with an atmospheric pressure ionization source 22. In the mass spectrometer, ion source 22 is positioned in a high-pressure $p_0$ region (e.g., atmospheric pressure region) which generates ions 24 from a sample being analyzed. In one embodiment of the invention, the ions enter a vacuum chamber 32 (an elevated pressure region) through a heated capillary 26, where ions are entrained in gas flow created by a pressure difference between capillary ends.

In one embodiment of the invention, a vacuum chamber 32 houses an RF ion focusing device 28 (e.g., a multipole ion guide) and conductance limit 36. The conductance limit 36 separates vacuum chamber 32 operated at an elevated pressure $p_1$ (e.g., 1-30 Torr) and high vacuum chamber 38 (i.e., a lower pressure region) which may house additional ion guides or a mass analyzer 40. In one embodiment of the invention, the RF ion focusing device 28 radially confines and focuses ions 24 from a free gas jet at the exit of the heated capillary 26 to the conductance limit opening. In one embodiment of the invention, RF voltage is provided to the ion focusing device 28 by power supply 30. (Power supply 30 or a separate supply may also provide an offset DC voltage.) In one embodiment of the invention, the pressure $p_1$ in the vacuum chamber 32 is maintained by pump 34.

Figure 3:
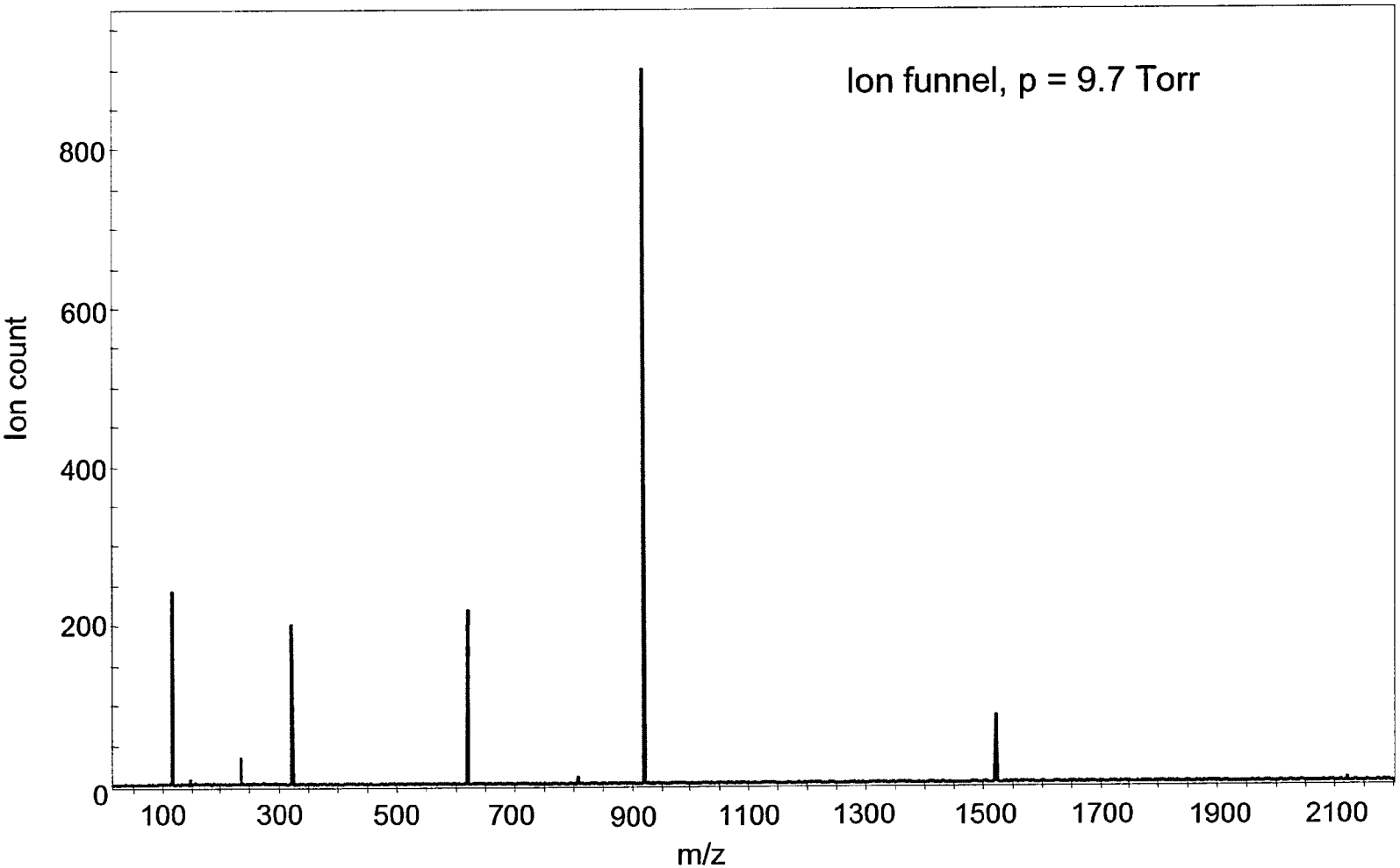
FIG. 3 is a mass spectrum of a tuning mixture obtained using ESI ion source and an ion funnel for ion transfer at elevated pressure.

The performance of a conventional quadrupole ion guide (four rods) was tested by recording ion signal in the time-of-flight mass analyzer with orthogonal acceleration by multi-channel plate (MCP) detector and time-to-digital converter (TDC). TDC provided ion count recording. Ions were generated by electrospray ionization from an Agilent tuning mix (P/N G2431A). Ion transmission of the quadrupole ion guide (6.35 mm dia rods) driven by an RF voltage of 250 Vp-p at 1.2 MHz significantly dropped (more than one order of magnitude) at pressures higher than 4.0 Torr in the vacuum chamber 32. In another test the quadrupole ion guide was replaced by the ion funnel made of 0.5 mm thick plates separated by 0.5 mm spacers with inner diameters decreasing from 22 mm to 1.5 mm, that demonstrated high ion transmission efficiency in the investigated pressure range (1-12 Torr). The recorded spectrum when using ion funnel as ion focusing device is shown in FIG. 3.

Figure 1B:
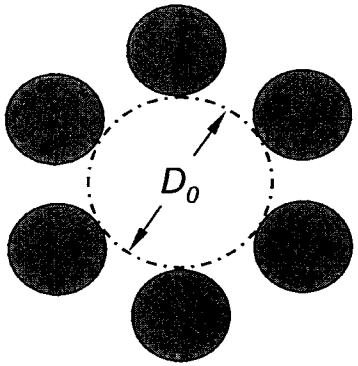
FIG. 1B is a schematic view of a hexapole showing the inscribed diameter in relation to the poles.

FIG. 1B is a schematic view of a hexapole showing the inscribed diameter in relation to the poles. The inventors found that a hexapole ion guide with an inscribed diameter of 5.1 mm showed similar performance to the conventional quadrupole ion guide described above. With the 5.1 mm inscribed diameter hexapole ion guide, ion transmission significantly dropped at 3.0-4.0 Torr pressure in the vacuum chamber 32, especially for high m/z ions. At the inscribed diameter of 5.1 mm, the RF amplitude applied to rods was limited to ~400 $V_{p-p}$ by appearance of gas discharge.

Figure 2:
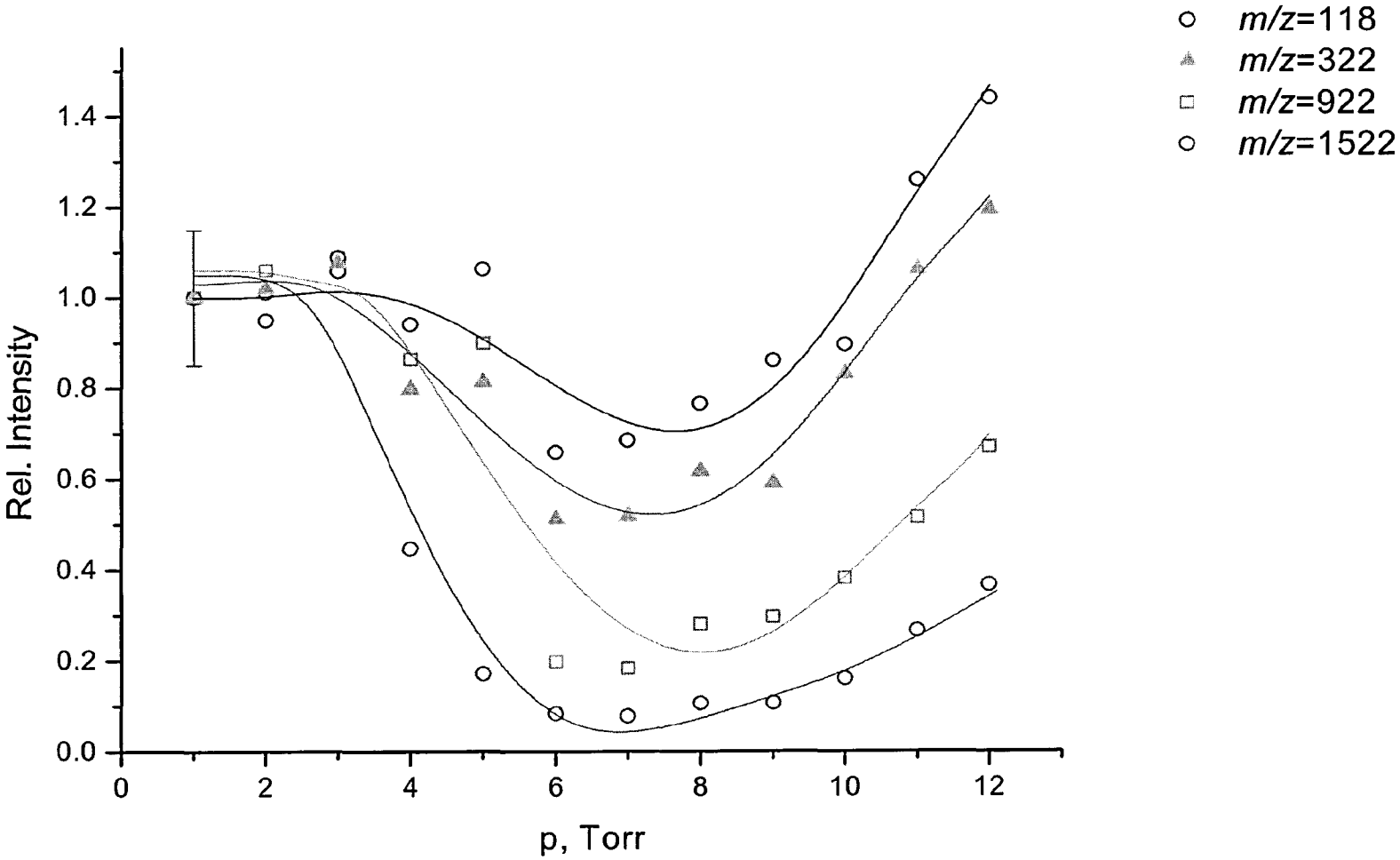
FIG. 2 is a graph depicting an ion transmission efficiency of miniature hexapole ion guide versus pressure.

However, the inventors discovered that reducing the inscribed hexapole ion guide diameter to 2.5 mm resulted in a significant increase in ion radial confinement by the RF field. FIG. 2 shows the pressure dependence of ion transmission efficiency when using the miniature hexapole ion guide with an inscribed of diameter 2.5 mm. While not limited to the following explanation, the increase of ion transmission at higher (≧9 Torr) pressures is explained by a "dragging" of ions by converging continuum gas flow at the region in a vicinity of the ion guide exit and the conductance limit (the mean free path $\lambda$ at 9 Torr is about 0.02 mm and the conductance opening hole diameter d is 1 mm). This effect would be higher at higher pressures. However, ion trapping conditions in a transverse (radial) direction at these high pressures can be realized only in multipole ion guides with very small size (i.e., having even smaller inscribed diameters).

Figure 4:
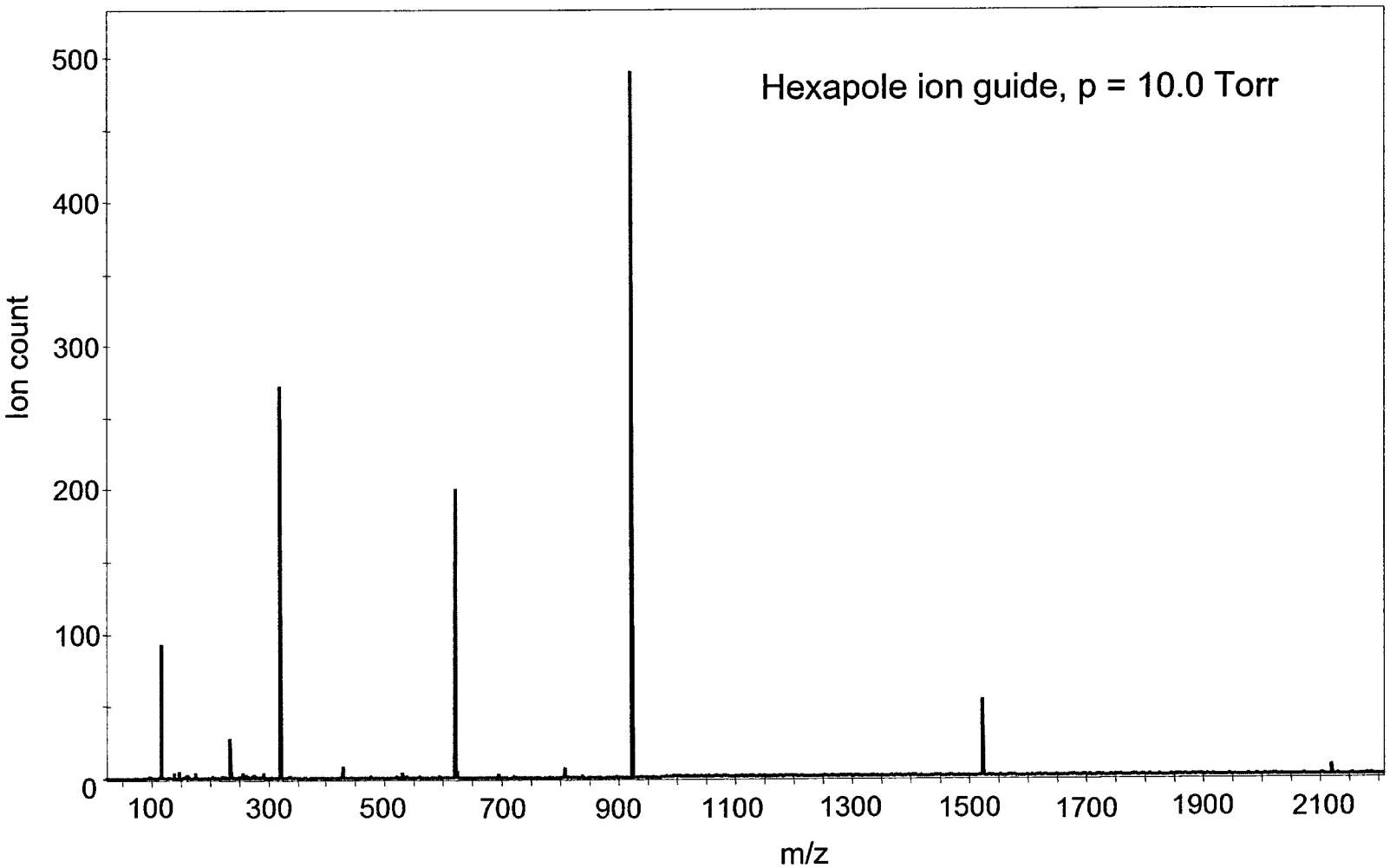
FIG. 4 is a mass spectrum of a tuning mixture obtained using ESI ion source and a miniature hexapole ion guide for ion transfer at elevated pressure.

In the case of hexapole ion guide with a 5.1 mm inscribed diameter, deterioration of ion trapping in radial direction at 3.0-4.0 Torr pressure significantly reduces ion transmission. The reduction of the inscribed diameter to 2.5 mm allows to maintain sufficient radial confinement for the ions to be "dragged" by the gas flow through the conductance limit. The spectrum of the same tuning mix, when using the miniature hexapole ion guide, is shown in FIG. 4. The spectrum demonstrates ion transmission comparable to that of the ion funnel at ~10 Torr pressure in the vacuum chamber 32. In addition to simpler design and reduced RF power requirements, the miniature hexapole ion guide also permits a smaller conductance limit 36, compared to the ion funnel (the ion funnel with small exit hole exhibit strong discrimination against low mass ions), thus decreasing the gas load into the lower vacuum chamber 38. A hexapole allows for a smaller size to conductance limit 36 because there is no induced alternating voltage on the conductance limit 36 after the hexapole ion guide due to symmetry (three "plus" poles and three "minus" poles). In the case of an ion funnel, only the last plate of the ion funnel is located in close proximity to the conductance limit 36. As a result, alternative voltage is induced at the conductance limit 36. This creates a potential barrier at the conductance limit 36, which low m/z ions cannot overcome.

The embodiments discussed herein are illustrative of the present invention. Various modifications or adaptations of the methods and/or specific structures described as apparent from the art can be used in this invention. As one example (but not limiting one), the opening in the conductance limit may be of a various shape, like round, square, or gap (an elongated rectangle). The rod shapes in the multipole ion guide may also be different from the round ones used in our examples. Different number of poles (e.g., quadrupole, hexapole, octopole, etc.) can be used for radial ion confinement. Besides the RF field, an additional DC field can be applied in axial (longitudinal) direction of the multipole ion guide to facilitate ion motion toward the conductance limit opening.

In general, the present invention provides for a device and method for transporting ions in an elevated gas pressure region. The device includes a multipole ion guide having a set of rods positioned along a longitudinal direction configured with an inscribed diameter equal to or less than 3.5 mm. The set of rods have an entrance and an exit for the ions. The device includes a voltage source which provides alternating voltages applied to at least a subset of the rods to create a trapping field in a transverse direction. The device includes a conductance limit having an opening d placed at the exit of multipole ion guide. The conductance limit separates the elevated gas pressure region having a molecular mean free path of $\lambda$ from a low gas pressure (or higher vacuum) region.

The rods of the multipole ion guide and the opening of the conductance limit provide a converging continuum gas flow through the conductance limit with a ratio of $\lambda/d<0.03$ which transfers the ions collimated near the center of the ion guide into the low gas pressure region. Hence, the invention provides a method for transporting ions in an elevated gas pressure region which subjects the ions at the multipole ion guide exit to a converging continuum gas flow through the conductance limit. Multiple collisions with gas molecules having velocities directed towards the conductance limit opening results in efficient ion transfer from elevated pressure region into low gas pressure region.

In one embodiment of the invention, the transverse size of each rod is less than 1.5 mm. Further, there can be multiple sets of the rods, and in each subset the transverse size (i.e., rod diameter size) of each rod is less than 1.5 mm.

In one embodiment of the invention, the size of the opening of the conductance limit d is ≦1.5 mm. In one embodiment of the invention, the conductance limit is located at distance equal to or less than 1 mm from the exit of the multipole ion guide. In one embodiment of the invention, the pressure in the elevated gas pressure region is equal to or higher than 5 Torr. In one embodiment of the invention, the pressure in the elevated gas pressure region is equal to or higher than 10 Torr.

In one embodiment of the invention, the rods are positioned parallel to each other. Similarly, rods in each subset can be positioned parallel to each other in the set and parallel to rods in the other subsets. In one embodiment of the invention, the rods are slightly inclined to the longitudinal direction. Similarly, rods in each subset can be slightly inclined to the longitudinal direction to each other in the set and slightly inclined to the longitudinal direction to rods in the other subsets. In one embodiment of the invention, the set of rods includes even numbers of the rods equidistantly positioned around the longitudinal direction.

In one embodiment of the invention, the rods (or rods in the subsets) are round in cross section. In one embodiment of the invention, the rods (or rods in the subsets) are square in cross section. In one embodiment of the invention, the rods (or rods in the subsets) have cross sections that are the same along the longitudinal direction.

In one embodiment of the invention, the opening in the conductance limit is at least one of a round hole, a square hole, or a gap hole.

In one embodiment of the invention, the longitudinal direction is a straight direction or a series of straight directions. In one embodiment of the invention, the longitudinal direction is a curved direction or a series of curved directions. In one embodiment of the invention, the longitudinal direction can be a mixture of straight and curved directions.

In one embodiment of the invention, the alternating voltages are sinusoidal voltages. In one embodiment of the invention, the alternating voltages include two counter phase voltages (i.e., 180 degrees out of phase) each applied to adjacent rods positioned equidistantly around the longitudinal direction. Furthermore, a DC supply can provide a DC potential along the longitudinal direction by way of supplemental electrodes around the multipole.

In one embodiment of the invention, the capillary 26 and the pump 34 provide a mechanism for creating a gas flow along the longitudinal direction. The gas introduced can include air. The ions can be delivered to the entrance of the multipole guide through the capillary 26. The capillary can deliver ions from an ion source located in an atmospheric pressure region. The ions can be delivered to the entrance of the multipole guide through a thin plate with an orifice. The orifice can deliver the ions from an ion source located in an atmospheric pressure region.

In one embodiment of the invention, the pressure in the high vacuum region can be between 1 and 200 mTorr. In one embodiment of the invention, the inscribed diameter is equal to or less than 2.5 mm.

Having generally described this invention, a further understanding can be obtained by reference to certain specific examples which are provided herein for purposes of illustration only and are not intended to be limiting unless otherwise specified.

Numerous modifications and variations of the invention are possible in light of the above teachings. It is therefore to be understood that within the scope of the appended claims, the invention may be practiced otherwise than as specifically described herein.

The invention claimed is:

1. A device for transporting ions along a longitudinal direction in an elevated gas pressure region, comprising:

a multipole ion guide having a set of rods positioned along the longitudinal direction on an inscribed diameter equal to or less than 3.5 mm, said set having an entrance and an exit for the ions; a voltage source which provides alternating voltages applied to at least a subset of the rods to create a trapping field in a transverse direction;

a conductance limit having an opening d placed at the exit of the multipole ion guide, the conductance limit separating the elevated gas pressure region having a molecular mean free path of $\lambda$ from a low gas pressure region;

wherein a converging continuum gas flow is provided through said conductance limit which transfers the ions collimated near a center of said ion guide into said low gas pressure region.

2. The device as in claim 1, wherein a ratio of $\lambda/d<0.03$.

3. The device as in claim 1, wherein the rods each have a transverse size less than 1.5 mm.

4. The device as in claim 1, wherein the opening of said conductance limit d is $\leqq 1.5$ mm.

5. The device as in claim 1, wherein said conductance limit is located at distance equal to or less than 1 mm from the exit of said multipole ion guide.

6. The device as in claim 1, wherein the pressure in the elevated gas pressure region is equal to or higher than 5 Torr.

7. The device as in claim 1, wherein the pressure in the elevated gas pressure region is equal to or higher than 10 Torr.

8. The device as in claim 1, wherein said rods are positioned parallel to each other.

9. The device as in claim 1, wherein said rods in the subset are slightly inclined to the longitudinal direction.

10. The device as in claim 1, wherein said rods are round in cross section.

11. The device as in claim 1, wherein said rods are square in cross section.

12. The device as in claim 1, wherein cross sections of said rods are the same along the longitudinal direction.

13. The device as in claim 1, wherein said opening is at least one of a round hole, a square hole, and a gap hole.

14. The device as in claim 1, wherein said longitudinal direction comprises a straight direction.

15. The device as in claim 1, wherein said longitudinal direction comprises a curved direction.

16. The device as in claim 1, wherein said alternating voltages are sinusoidal voltages.

17. The device as in claim 1, wherein said multipole ion guide comprises a set of rods including an even numbers of the rods equidistantly positioned around the longitudinal direction.

18. The device as in claim 17, wherein said alternating voltages include two counter phase voltages each applied to adjacent rods positioned equidistantly around the longitudinal direction.

19. The device as in claim 1, further comprising a mechanism which creates a DC potential along the longitudinal direction.

20. The device as in claim 1, further comprising a mechanism which creates a gas flow along the longitudinal direction.

21. The device as in claim 20, wherein said gas flow comprises air.

22. The device as in claim 1, further comprising a capillary to deliver said ions to the entrance of said multipole guide.

23. The device as in claim 1, further comprising an atmospheric pressure ion source and a capillary, said capillary delivers said ions from the atmospheric pressure ion source to the entrance of said multipole guide.

24. The device as in claim 1, further comprising an orifice which delivers said ions to the entrance of said multipole guide.

25. The device as in claim 1, further comprising an atmospheric pressure ion source and an orifice, said orifice delivers said ions from the atmospheric pressure ion source to the entrance of said multipole guide.

26. The device as in claim 1, wherein the pressure in the low gas pressure region is between 1 and 200 mTorr.

27. The device as in claim 1, wherein said inscribed diameter is equal to or less than 2.5 mm.

28. A method for transporting ions along a longitudinal direction in an elevated gas pressure region, comprising:

injecting ions into the elevated gas pressure region of an ion guide;

transporting the ions in a converging continuum gas flow which transfers the ions collimated near a center of said ion guide out of the elevated pressure of the ion guide into a low gas pressure region.

29. A system for transporting ions along a longitudinal direction in an elevated gas pressure region, comprising:

means for injecting ions into the elevated gas pressure region of an ion guide;

means for transporting the ions in a converging continuum gas flow which transfers the ions collimated near a center of said ion guide out of the elevated pressure of the ion guide into a low gas pressure region.

* * * * *

UNITED STATES PATENT AND TRADEMARK OFFICE

CERTIFICATE OF CORRECTION

PATENT NO. : 8,440,964 B2
APPLICATION NO. : 13/213787
DATED : May 14, 2013
INVENTOR(S) : Vadym D. Berkout et al.

It is certified that error appears in the above-identified patent and that said Letters Patent is hereby corrected as shown below:

On the title page, Item (54) and in the specification, column 1, the title is incorrect. Item (54) and column 1 should read:

--MULTIPOLE ION GUIDE OPERATING AT ELEVATED PRESSURES--

Signed and Sealed this
Ninth Day of July, 2013

Teresa Stanek Rea
*Acting Director of the United States Patent and Trademark Office*